US006966245B1

(12) United States Patent
Simpson

(10) Patent No.: US 6,966,245 B1
(45) Date of Patent: Nov. 22, 2005

(54) TRIM EDGE STRIPPER FOR A CORRUGATED BOARD ROTARY CUTTING DIE

(75) Inventor: Jack Richard Simpson, Raleigh, NC (US)

(73) Assignee: Container Graphics Corporation, Cary, NC (US)

( * ) Notice: Subject to any disclaimer, the term of this patent is extended or adjusted under 35 U.S.C. 154(b) by 732 days.

(21) Appl. No.: 09/054,564

(22) Filed: Apr. 3, 1998

(51) Int. Cl.[7] ..... B23D 25/02

(52) U.S. Cl. ..... 83/27; 83/303; 83/310; 83/314; 83/348

(58) Field of Search ..... 83/27, 116, 117, 83/222, 303, 310, 314, 322, 323, 331, 348, 513, 514, 515, 516

(56) References Cited

U.S. PATENT DOCUMENTS

| | | | | | |
|---|---|---|---|---|---|
| 1,751,562 | A | * | 3/1930 | Stinger | 83/115 |
| 3,703,841 | A | * | 11/1972 | Crawford | 83/348 |
| 3,803,963 | A | * | 4/1974 | Hunt | 83/116 |
| 3,921,481 | A | * | 11/1975 | Fleetwood | 83/117 |
| 4,224,851 | A | * | 9/1980 | Imai | 83/117 |
| 4,349,140 | A | * | 9/1982 | Passafiume | 83/348 |
| 4,499,802 | A | * | 2/1985 | Simpson | 83/117 |
| 4,785,832 | A | * | 11/1988 | Gherardi et al. | 83/348 |
| 5,111,725 | A | * | 5/1992 | Simpson et al. | 83/117 |
| 5,161,442 | A | * | 11/1992 | Rilitz et al. | 83/117 |
| 5,363,728 | A | * | 11/1994 | Elsner et al. | 83/116 |
| 5,417,132 | A | * | 5/1995 | Cox et al. | 83/116 |
| 5,636,559 | A | * | 6/1997 | Smithwick, Jr. et al. | 83/116 |
| 5,881,620 | A | * | 3/1999 | Smithwick, Jr. et al. | 83/116 |
| 6,644,153 | B1 | * | 11/2003 | Gordon | 83/116 |

* cited by examiner

*Primary Examiner*—Allan N. Shoap
*Assistant Examiner*—Jason Prone
(74) *Attorney, Agent, or Firm*—Coats & Bennett, P.L.L.C.

(57) ABSTRACT

A rotary cutting die includes a trim stripper having a generally pentagonal shape which forcibly separates severed trim scrap from cut corrugated board, directing the scrap material generally downwardly and away from the trimmed corrugated board product. The pentagonal shaped stripping member mounts on the surface of a die board adjacent a trim cutting blade and is formed of a resilient material, such as closed cell rubber, which deforms elastically when forced into contact with the incoming blank of material. The angled nature of the stripper surface allows the stripper to smoothly contact and capture the leading edge of the blank, greatly reducing the potential for an initial destructive misalignment at the stripper-blank interface. More particularly, the angled upper surface of the pentagonal shaped member is oriented such that as the stripper is brought into contact with the blank and deformation of the resilient stripper occurs, the engaged angled surface tends to hold the blank material against an adjacent anvil cylinder. Simultaneous with this holding action of the stripper, the cutting blade engages and penetrates the blank material, effectively severing or trimming the edge of the blank and producing a segment of scrap. As the elastically deformed stripper begins to recoil, and return to it's original pentagonal shape, the angled surface of the stripper remains in general contact with the severed scrap and continues to hold the scrap material firmly against the anvil surface. By doing such, the stripper effectively forces the severed scrap material to be expelled from the rotary die assembly along a tangent to the anvil cylinder that is angled or directed significantly lower than the path taken by the trimmed corrugated board product.

35 Claims, 11 Drawing Sheets

TRIM EDGE STRIPPER FOR A CORRUGATED BOARD ROTARY CUTTING DIE

FIELD OF THE INVENTION

The present invention relates to corrugated board rotary cutting dies and the stripping of scrap therefrom, and more particularly to a stripping member for efficiently and effectively directing scrap away from an edge trimming cutting die.

BACKGROUND OF THE INVENTION

Rotary or drum-type cutting dies are commonly used for producing a corrugated board container or carton blank from corrugated board sheet material. Such rotary dies are typically comprised of a pair of cooperating cylinders or drums. One of the cylinders, a cutting cylinder, contains cutting blades or rules while the other, an anvil cylinder, provides a backing surface against which the cut is made.

Rotary cutting dies of the type described above are typically employed to trim the leading and trailing edges of the corrugated board blanks during a die cutting operation. As such, provisions for removing or stripping the severed trim scrap from the cutting die must be provided. Otherwise, if not actively removed from the vicinity of the cutting die, the scrap material tends to collect between the trim cutting blades and adjacent scrap strips which can result in serious damage to the die board and may ultimately render it inoperable.

Over the past decade, consumers have begun to demand corrugated board products that are completely or nearly completely free of the scrap resulting from die cutting operations. In certain applications, such as in the food packaging industry, it is not uncommon for the presence of minute quantities of scrap material dispersed amongst a stack or pallet of finished corrugated board packaging product to constitute grounds for rejection of the entire stack of product. Therefore, an additional consideration with regard to the stripping or ejection of corrugated board scrap, is the direction in which the successfully stripped or ejected scrap exits the cutting die assembly. As the usable product of the cutting process is typically expelled directly outward from the nip of the rotary cutting die assembly, it is desirable, in order to obtain complete separation of scrap and product, that the scrap be ejected from the rotating cylinders at a significantly different trajectory than the product.

In the past, resilient rubber pads or strips made of closed cell, high density foam or gum rubber have been placed immediately adjacent the edge trimming blades so as to forcibly eject the trimmed scrap material. However, previous resilient trim strippers have suffered from a number of shortcomings. In cases of lead trim strippers, the respective stripper pads are placed just forwardly of the lead trim blades. To be effective, these strippers must normally project outwardly past the trim blades. Because the strippers normally include generally flat sides and edges, the portion of the strippers that projects outwardly past the trim blades present an unforgiving, generally abrupt initial contact surface for incoming sheets of corrugated board. What typically happens here is that the lead edge of the corrugated board being fed into the die has a tendency to ram the side of the stripper projecting downwardly past the trim blade, causing the stripper to be urged forwardly away from the trim blade. When this ramming action repeats itself, as it can do in a die cutting operation, a number of problems can be anticipated.

First, cut trim scrap often becomes jammed or lodged between the stripping member and the cutting blade. As scrap accumulates between the stripping member and the cutting blade, the resilient stripping member can be deformed so as to render it functionally ineffective and furthermore, can actually be pried loose from the cutting die to which it is mounted. In addition to damaging the stripping members, scrap accumulated in the vicinity of the cutting blade can also become wedged between the die board and the blade mounted therein. In such cases, the wedged scrap material may cause the blade to be loosened and begin to wobble within the die board, and in extreme cases, the wedged scrap material may actually crack the die board, rendering it inoperable.

In other cases, the accumulation of unwanted scrap material around the stripper may significantly alter the effective pliability or elastic characteristics of the resilient stripper. As such, the stripping member may actually deform the urethane coating on the adjacent anvil cylinder, thus rendering the cutting die assembly functionally ineffective.

Therefore, there remains a need for a practical, reliable, and cost effective resilient edge trim stripping member for use with corrugated board rotary cutting dies which prevents the accumulation of trim scrap material around the stripping member or members and which furthermore provides for directional control of the ejected or stripped scrap as it exits the rotary cutting die apparatus.

SUMMARY OF THE INVENTION

The present invention entails a rotary cutting die for cutting corrugated board. The cutting die includes a base that is adapted to be mounted to a rotating cylinder. Secured within the base is a series of trim blades that act to cut trim scraps from around selected portions of a sheet of corrugated board. Disposed adjacent the trim blades is a series of trim strippers that function to strip cut trim scrap from the trim blades during a die cutting operation. Each of the trim strippers includes an upper angled surface that engages cut trim scrap and strips the trim scrap from an adjacent trim blade. The angled upper surface is oriented with respect to the trim blade such that it extends outwardly past the trim blade and at the same time extends at an angle away from the adjacent trim blade.

In particular, in the case of leading edge trim, the respective trim strippers are disposed on the forward or leading side of the trim blade or blades. The angled upper surface of the trim stripper extends outwardly past the trim blade while angling away and generally forwardly from the trim blade. Thus, the angled surface of the trim stripper forms a non-abrupt surface for contact with the oncoming leading edge of a sheet of corrugated board being fed between the cutting die and an associated anvil. Further, the angled nature of the upper surface acts to hold the cut trim scrap against the anvil for an extended period as the trim strippers and cut trim exit the nip between the cutting die and anvil. This results in the anvil actually directing the cut trim downwardly adjacent the anvil and serves to efficiently separate the trim scrap from the corrugated board product.

In another embodiment of the present invention, each trim stripper includes an outer portion and a flexible deflector extending outwardly from the outer portion of the stripper. In the case of lead edge trim, the flexible deflector happens to lead the trim cut from the lead edge of the corrugated board fed into the die assembly. As the trim stripper emerges from the nip between the cutting die and associated anvil, the deflector projects outwardly in front of the cut trim strip.

As the cut trim strip advances, it has a tendency to engage the backside of the deflector, causing the cut trim strip to be deflected downwardly onto the anvil.

It is therefore an object of the present invention to provide a rotary cutting die with leading edge trim strippers that provide for a relatively smooth entry of corrugated board sheets into the nip defined between the cutting die and an associated anvil.

Another object of the present invention resides in the provision of trim strippers for a cutting die that tends to prevent trim scrap from being lodged and jammed between the respective trim strippers and adjacent trim blades.

Still a further object of the present invention resides in the provision of a trim stripper for a cutting die that tends to engage and hold cut trim scrap against an associated anvil after the cut trim has exited the nip between the cutting die and the anvil such that the cut trim tends to follow the anvil and in the process is directed generally downwardly adjacent the anvil.

DETAILED DESCRIPTION OF THE INVENTION

Figure 1:
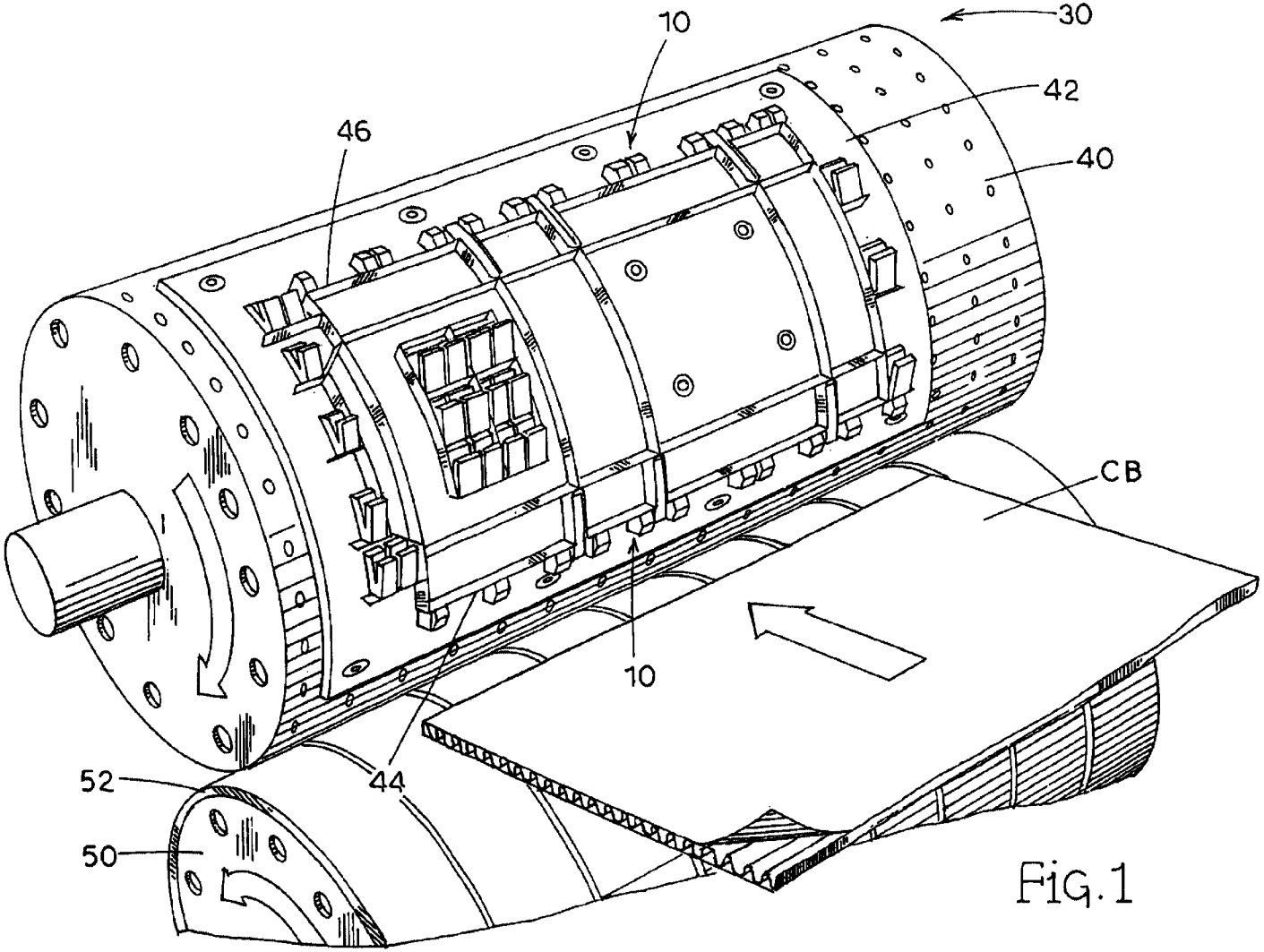
FIG. 1 is a perspective view of a typical corrugated board rotary die cutting apparatus.

Shown in FIG. 1 is a corrugated board rotary die cutting apparatus, generally indicated by the numeral 30. Die cutting apparatus 30 is comprised of a pair of rotatably mounted, cooperating cylinders or drums. More particularly, the die cutting apparatus 30 includes a cutting cylinder 40 and an anvil cylinder 50. Mounted on the cutting cylinder 40 is a generally cylindrical die board 42, which is typically made of laminated plywood. Die boards, such as that illustrated in FIG. 1, typically include a combination of cutting blades, creasing rules, resilient scrap strippers, resilient product ejectors, and the like. As such and with particular regard to the invention disclosed herein, die board 42 includes a series of leading edge trim cutting blades 44, which are securely mounted therein such that the cutting tips of the blades 44 protrude and extends generally outwardly away from the surface of the cylinder 40. Each trim cutting blade 44 includes a pair of opposed sides or edges 44*a* and 44*b*. For purposes of reference, edge 44*a* is referred to as a scrap edge while the other side 44*b* is referred to as a product edge. It should be pointed out that the scrap edge 44*a* and product edge 44*b* are defined relative to the edge of a blank of corrugated board CB that is to be trimmed. That is, as the cutting blade 44 moves into position and begins to penetrate the incoming blank of corrugated board CB, the blade effectively divides the blank into a trim or scrap region and a product region. The scrap edge 44*a* of the cutting blade 44 is defined herein as the edge or side of the cutting blade that is immediately adjacent the scrap region. As such, the scrap edge 44*a* of the cutting blade will also be immediately adjacent and face the scrap material 62 (FIGS. 4C–4F) that is severed from the blank during the cutting process. Conversely, the product edge 44*b* of the cutting blade 44 is defined herein as the edge or side of the cutting blade that is immediately adjacent the finished or product region of the blank CB.

Die board 42 also includes a series of trailing edge trim cutting blades 46, which are securely mounted therein such that the cutting tips of the blades 46 protrude and extends generally outwardly away from the surface of the cylinder 40. It will be appreciated that, as with the leading trim blades 44, the trailing trim blades 46 also includes a scrap edge and a product edge, which are defined in a manner analogous to that of the leading blade edges.

As shown in FIG. 1, further disposed on the surface of the die board 42, immediately adjacent the leading and trailing trim blades 44 and 46, respectively, are a series of resilient trim strippers, generally indicated by the numeral 10. In the case of the leading trim blades 44, the trim strippers 10 are disposed such that they lead the trim blades 44 in the die cutting process. Consequently, the trim strippers 10 are disposed rearwardly of the leading trim blades 44. Relative to the trailing trim blades 46, the trim strippers 10 are disposed so as to trail these blades. Consequently, these trim strippers 10 are said to be disposed forwardly of the trailing trim blades 46.

Figure 2:
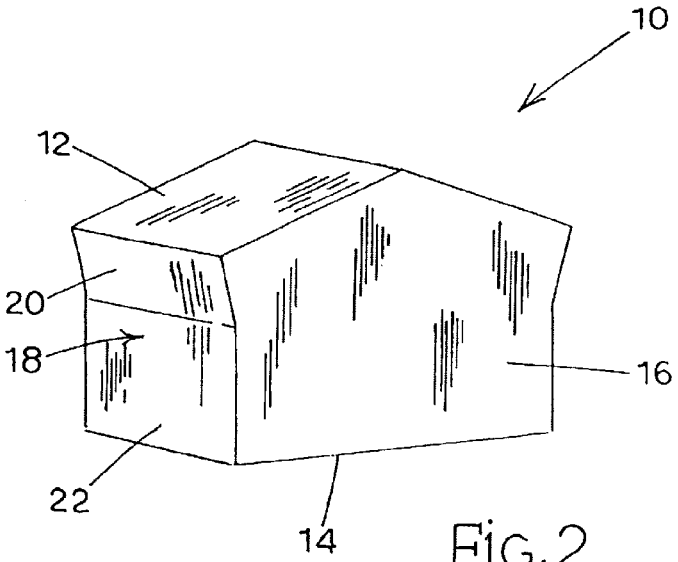
FIG. 2 is a perspective view of the trim stripper of the present invention.
Figure 3A:
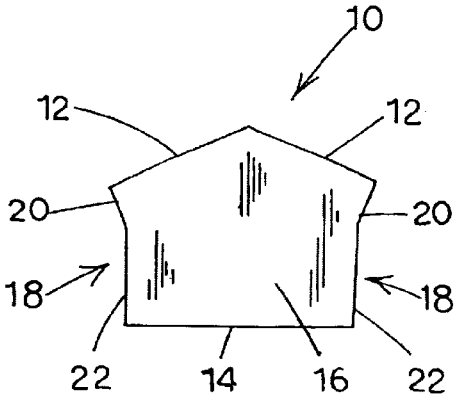
FIG. 3A is a side elevational view of the trim stripper of FIG. 2.
Figure 3B:
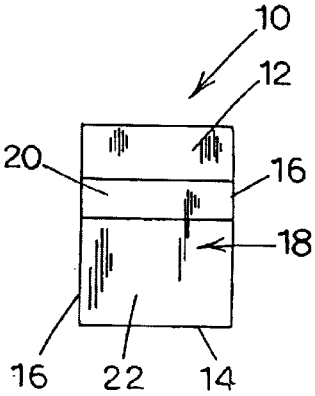
FIG. 3B is a left side elevational view of the trim stripper of FIG. 2 viewed from one end.
Figure 3C:
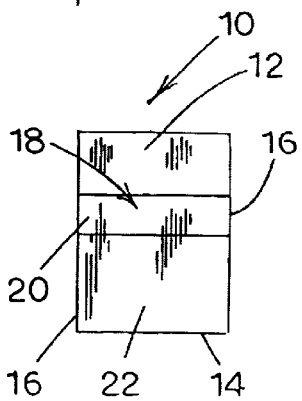
FIG. 3C is an elevational view of the trim stripper of FIG. 2 viewed from the other end.

Shown in FIG. 2 is a first embodiment of the resilient trim stripper 10, which includes a generally pentagonal shape, with the top of this pentagon being comprised of a pair of angled stripper surfaces 12. As illustrated in FIGS. 3A–3C, the pentagonal shaped stripper 10 further includes a generally horizontal base 14, and a pair of generally vertical, sides 16. A pair of front and rear edge surfaces, generally indicated by the numeral 18, form the two remaining sides of the pentagonal shaped stripper 10. While the edge surfaces 18 are generally vertical in nature, the exact shape of these surfaces, in the embodiment illustrated, is in fact not linear. For purposes of illustration, each edge surface 18 may be considered to be comprised of a separate upper curved or bevel filler region 20 and a lower linear or flat region 22, as shown in FIGS. 2 and 3A. As will be appreciated from subsequent discussions, the filler region 20 is designed to fit flush against the upper beveled area of a respective trim blade 44 or 46 so as to effectively fill the beveled formed along one upper side or edge of the blade.

Figure 2A:
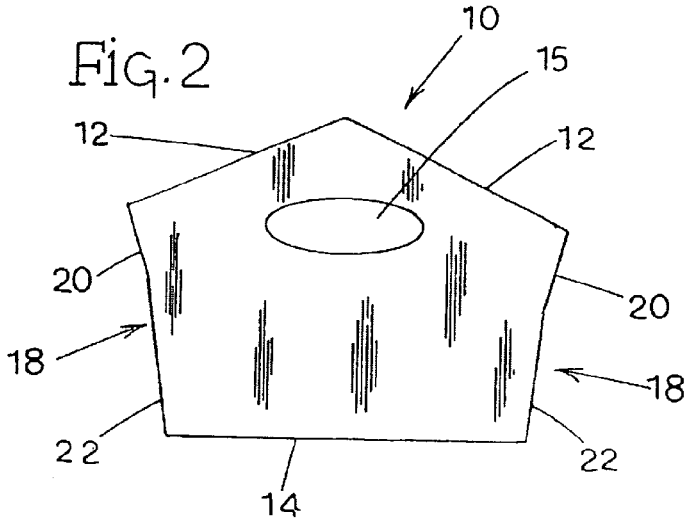
FIG. 2A is a side elevational view of an alternative design for the trim stripper.

FIG. 2A depicts a slightly different embodiment of the trim stripper 10 than that shown in FIG. 2. The embodiment of FIG. 2A is essentially the same as the embodiment of FIG. 2 except that an aperture 15 is formed in the body of the trim stripper 10. Although the aperture 15 may be placed or disposed in various portions of the trim stripper 10, in the case of the embodiment shown herein the aperture 15 extends transversely through the body of the trim stripper 10. Aperture 15 will generally make the trim stripper 10 more compressible for a given hardness. Thus by incorporating the aperture 15, in some cases it may be possible to extend the height of the trim stripper 10 for a given hardness.

Trim stripper 10 is typically manufactured from a resilient material such as a 70 to 100 durometer closed cell rubber, although foam or other materials exhibiting appropriate resilient characteristics may also be utilized.

As illustrated in FIG. 1, the anvil cylinder 50 is disposed adjacent the cutting cylinder 40 and is typically surrounded or sheathed with a surface layer or coating 52 of a relatively compliant material such as urethane, which provides a backing surface against which a cut can be made without damaging the cutting blades 44 and 46 or any other cutting blades or creasing rules disposed on the die board 42. As such, anvil cylinder 50 rotates in a manner that is generally synchronous with the adjacent cutting cylinder 40 during normal operation.

Returning now to a discussion of the cutting cylinder 40 configuration, the trim strippers 10 are typically positioned on the cutting die 42 immediately adjacent the cutting blades 44 and 46, as shown in FIG. 1. Each stripper 10 is further oriented such that the stripper base 14 is in contact with the die board 42, as shown in FIG. 4A. Securing of the trim stripper 10 to the die board 42 is generally accomplished through the use of chemical adhesives or glues which are applied to the stripper base 14, although other suitable securing techniques could be employed. Furthermore, the size of the base 14 is chosen so as to provide ample surface area for gluing, which ultimately leads to a more secure mounting and a generally longer stripper life span. The cutting blade configuration illustrated in FIGS. 4A–4F is for a leading edge type trimming operation, as opposed to side or trailing edge trimming. With the stripper base 14 contacting the die board 42, stripper 10 is further oriented such that one of the edge surfaces 18 abuts the scrap edge 44*a* of the trim cutting blade 44. Positioned as such, it will be appreciated that the contour of the stripper edge surface 18 allows the stripper 10 to mate tightly with the face of the adjacent cutting blade 44. That is, the upper curved or bevel filler region 20 of the stripper edge surface is contoured so as to generally conform to and mate with the beveled shape of the cutting blade tip, while the lower flat region 22 of the stripper edge surface fits flush against the lower portion of the cutting blade face.

As shown in FIG. 4A, when positioned adjacent the cutting blade 44 as described above, the angled stripper surface 12 disposed closest to the cutting blade is generally aligned flush with the blade tip in the embodiment shown. From the blade tip, the angled surface 12 extends generally outwardly and away from the scrap edge 44*a* of the blade. It should be appreciated that the other angled stripper surface 12 disposed furthest from the cutting blade is not actively involved in the functioning of the stripper. This second angled surface is included primarily as a matter of manufacturing and operational practicality. That is, the additional angled surface is in some respects a convenient side effect of the gluing area considerations related to the stripper base 14. As discussed previously, enlargement of the base 14 provides a larger gluing surface area for use in mounting the stripper 10 to the die board 42. Furthermore, the additional angled surface 12 is typically fabricated so as to have a different slope than the adjoining angled surface. This concept is illustrated in FIGS. 3B and 3C. Thus, the trim stripper 10 is reversal and the die operator can choose between two angled stripper surfaces depending upon the particular die configuration and the properties of the blank material to be trimmed.

As the operation and general construction of rotary die cutters of the type contemplated herein is well known and widely understood, a detailed discussion of the operational theory of corrugated board die cutters will not be presented. It is considered sufficient for the purposes of this disclosure to describe the rotary die cutter 30 contemplated herein as comprising the die cutting cylinder 40 and anvil cylinder 50, as described above. In general, these cylinders are rotatably mounted adjacent one another such that a small gap or nip 80 (see FIG. 4A) exists between their opposing surfaces. A partial view of such a typical cylinder configuration is shown in FIGS. 4A–4F. During normal operation, the cylinders are rotated in opposite directions relative to one another, at approximately the same speed. As such, movement of the cylinder surfaces in the immediate vicinity of the nip 80 will be generally in the same direction, with both surfaces moving at approximately the same speed. Once again, this concept of counter-rotation and uniform surface movement through the nip 80 is illustrated in FIGS. 4A–4F.

Figure 4B:
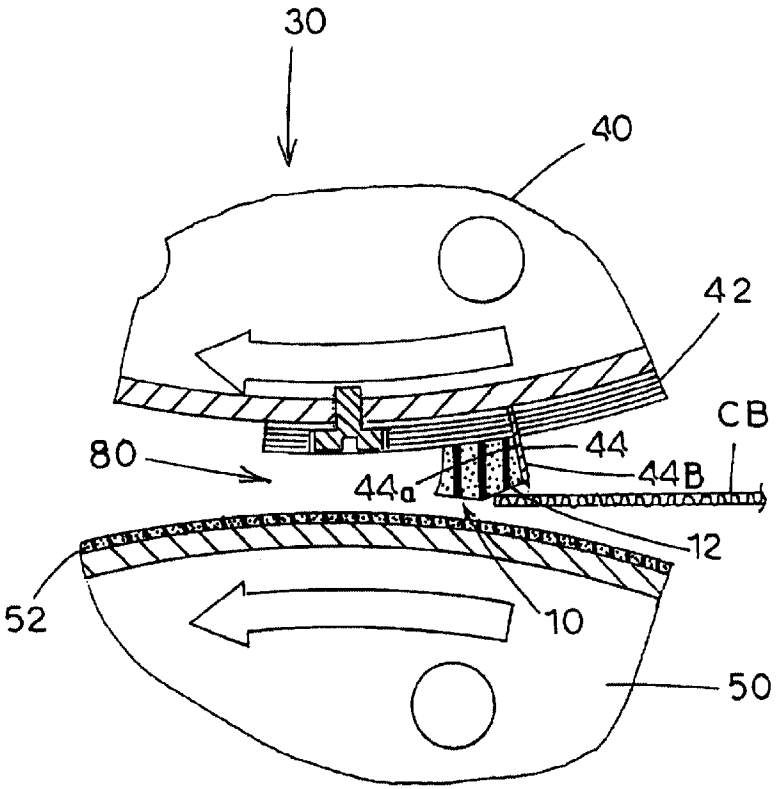
FIGS. 4A–4F are a sequence of fragmentary sectional views illustrating the movement of the trim stripper and a sheet of corrugated board through the nip defined between the cutting die and anvil of a rotary die cutting assembly.
Figure 4A:
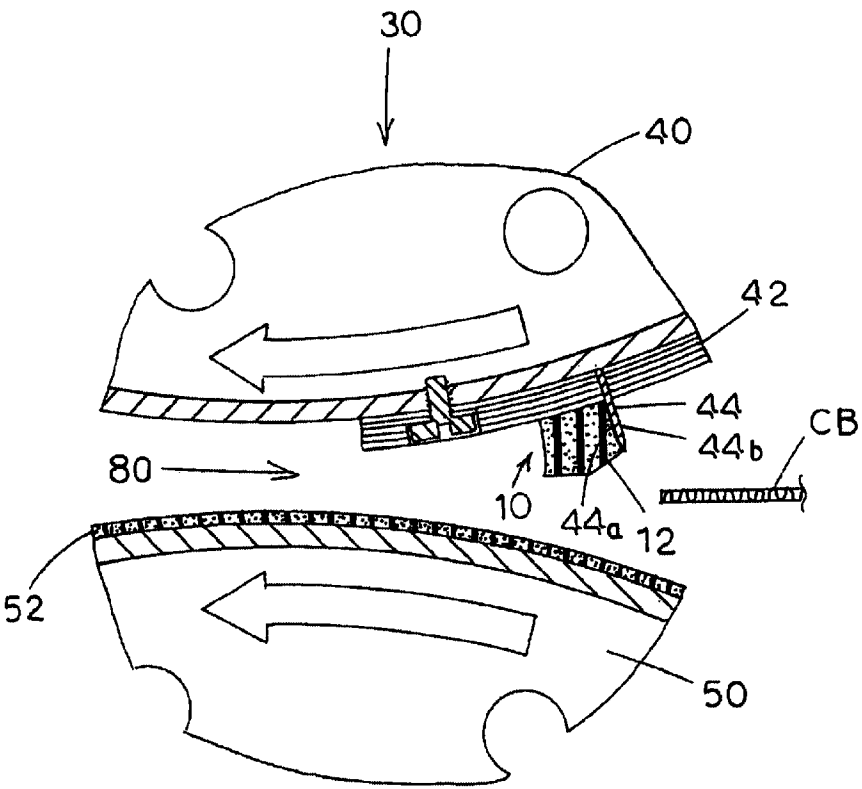

As previously stated, the trim stripper 10 illustrated in FIGS. 4A–4F is configured to act as a leading edge stripper and, as such, trimming and stripping of the corrugated board CB begins with the insertion or entry of the corrugated board blank CB into the die cutter 30. Insertion of the corrugated board CB into the die cutter is synchronized with the position of the trimming or cutting blade 44, such that the edge of the blank that is to be trimmed enters the nip 80 at approximately the same time as the cutting blade, as shown in FIG. 4A. The cutting blade 44 and incoming blank CB will tend to move together into and through the nip with the leading edge region of the blank that is to trimmed just leading the adjacent blade, as illustrated in FIG. 4B. It will be appreciated that as the blank CB approaches the nip 80, the blade 44 and integrally mounted stripper 10 move closer to the adjacent blank as a consequence of the cylindrical nature of the cutting die 40. As the angled surface 12 (that is the angle surface 12 adjacent the blade 44) of the stripper 10 extends beyond the tip of the cutting blade 44, the surface 12 makes first contact with the incoming blank CB. As described previously, there are two angled surfaces 12 which form the top of stripper 10, and under normal operating conditions it is the angled surface disposed adjacent and abutting the scrap edge 44*a* of the cutting blade 44 which is responsible for making first contact with the incoming blank, as illustrated in FIG. 4B. More particularly, synchronization of the blank and cutting blade 44 generally insures that the first contact made by angled surface 12 is with the edge or scrap region of the blank CB that is to be trimmed.

At this point, it should become apparent that the angled nature of the surface 12 allows the stripper to smoothly contact and capture the leading edge of the blank, greatly reducing the potential for an initial destructive misalignment at the stripper-blank interface. As further illustrated in FIG. 4C, synchronized movement of the cutting blade 44 and blank CB towards the nip 80 brings the blank, trim cutting blade 44, and stripper 10 continually closer together. The stripper 10, being constructed of a resilient material, tends to be elastically deformed by the encroaching blank material. The forces generated within the elastically deformed stripper 10 serve to press and hold the contacting blank material firmly against the adjacent anvil cylinder 50. Simultaneous with this holding action of the stripper 10, the cutting blade 44 engages and penetrates the blank material CB, effectively severing the leading edge of the blank and producing a segment of leading trim scrap 62, as shown in FIG. 4C. It should be appreciated that under normal operating conditions the cutting blade 44 will not only penetrate the blank material, but will also extend into and penetrate the urethane coating 52 that is disposed on the surface of the anvil cylinder 50.

Figure 4D:
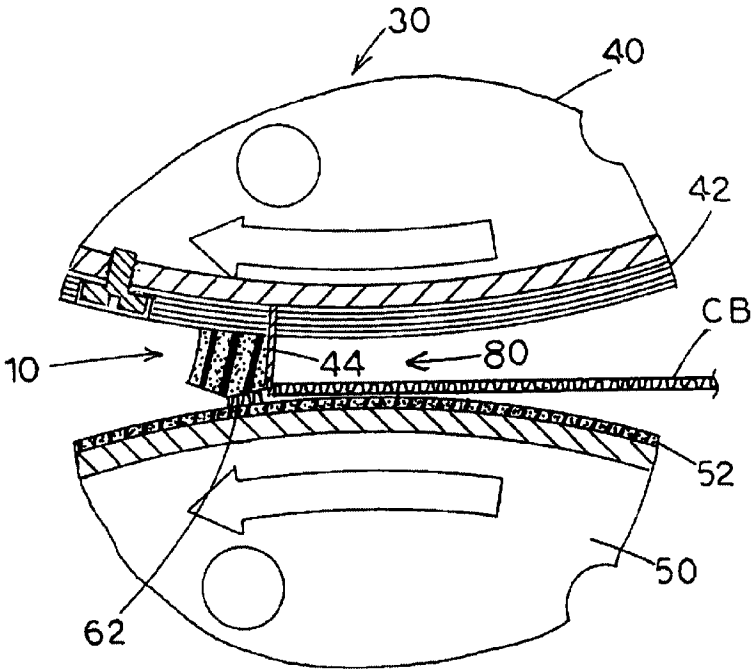
Figure 4C:
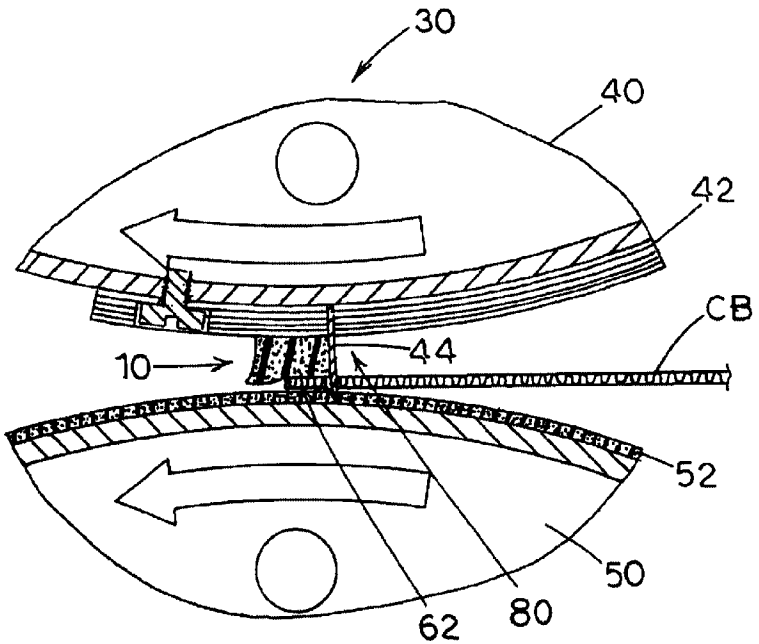
Figure 4F:
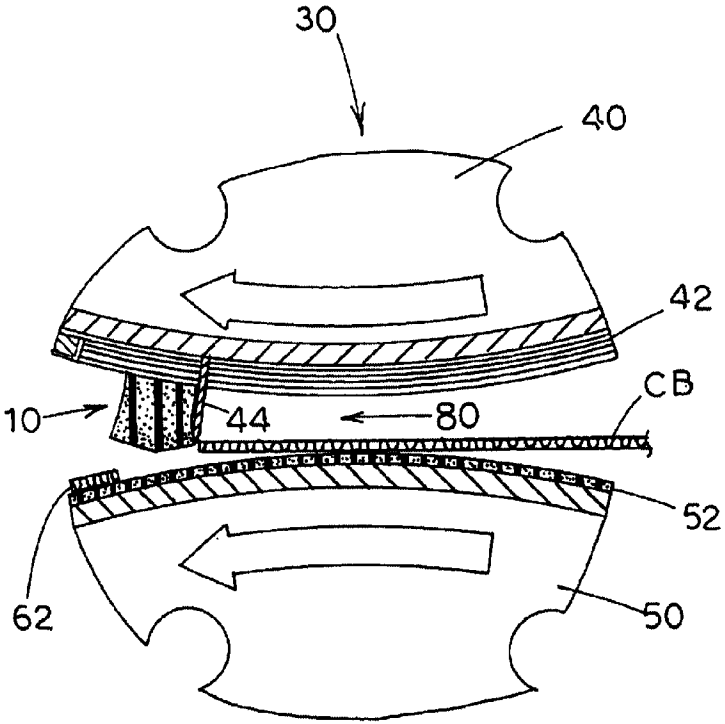
Figure 4E:
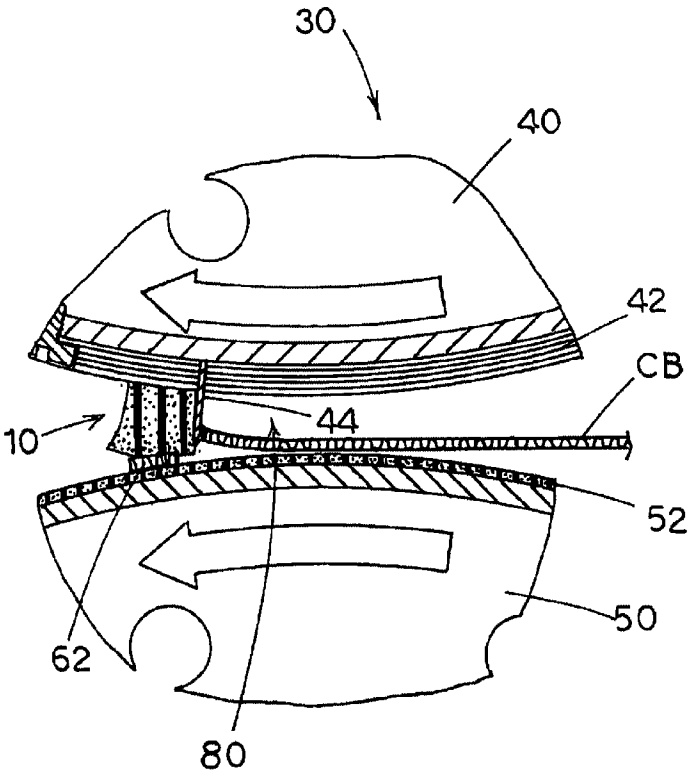

As the blank CB and newly formed trim scrap piece 62 proceed through and past the nip, it will be appreciated from FIG. 4D, that the blade 44 and integrally mounted stripper 10 tend to move generally away from the adjacent blank and scrap as a consequence of the cylindrical nature of the cylinders 40 and 50. As this separation of scrap 62 and stripper 10 proceeds, the elastically deformed stripper 10 begins to recoil, and in the process tends to return to its original, generally pentagonal shape. During this recoiling process, the angled surface 12 of the stripper remains in general contact with the severed trim scrap 62, and continues to hold the scrap material firmly against the receding anvil surface. By doing such, the stripper 10 effectively forces the severed scrap material 62 to be expelled from the die 30 along a tangent to the anvil cylinder 50 that is angled or directed significantly lower than the path taken by the trimmed blank material or product. That is, the trimmed blank product shown in FIGS. 4E and 4F will tend to exit the die cutter 30 along a straight path that is approximately horizontal, as it is not intentionally held against the surface of the downwardly rotating anvil cylinder 50 following the cut. The trim scrap 62, however, is effectively held against the downwardly rotating anvil 50 for a period of time following the cut, and hence acquires some amount of downward velocity from the anvil. As a consequence, the trim scrap 62 tends to be thrown generally downward and clear of both the die cutter 30 and the discharged corrugated board product.

Once again, it should be appreciated that the above descriptions and drawings (FIGS. 4A–4F) relate to a leading edge type stripping operations. As such, the stripper 10 is shown positioned on the left side of the cutting blade 44 in FIGS. 4A–4F. However, the die cutter could just as easily be configured to perform trailing edge type stripping operations, in which case the stripper 10 would be positioned against the right side of a trail edge cutting blade, with respect to the apparatus shown in FIGS. 4A–4F. It should be noted however that, as per the previous definitions and discussions provided above, in the case of trailing edge trimming operations, the right side or face of the blade would be considered the scrap edge, as the scrap region of the incoming blank would lie to the right of the cutting blade. In any event, the stripper 10 would function in much the same manner as that described above for lead edge trimming operations. That is, the stripper serves to hold the cut scrap edge of the blank against the anvil cylinder and effectively directs the severed scrap generally downwardly and away from the discharged blank product.

Figure 5:
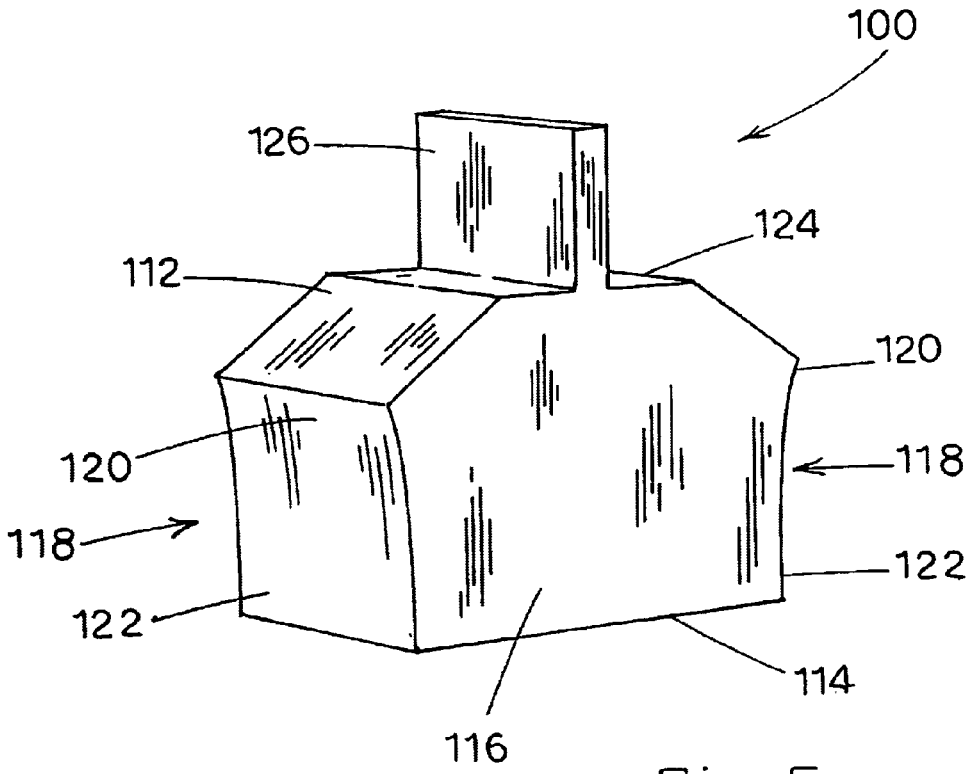
FIG. 5 is a perspective view of an alternative design for a trim stripper of the present invention.
Figure 6:
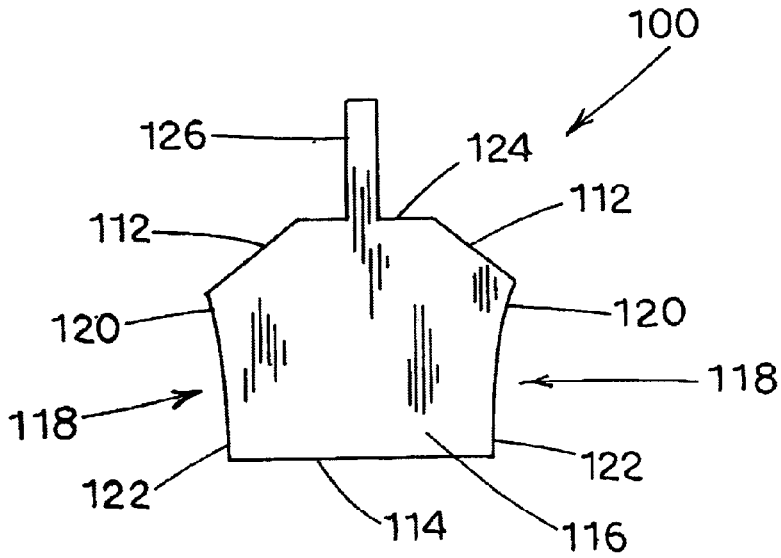
FIG. 6 is a side elevational view of a trim stripper shown in FIG. 5.

A trim stripper, representing a second embodiment and which is similar to the first embodiment described above, is shown in FIG. 5 and is generally indicated by the numeral 100. Trim stripper 100 also includes a pair of angled stripper surfaces 112, a generally horizontal base 114, and a pair of generally vertical, sides 116. A pair of edge surfaces, generally indicated by the numeral 118, form the two remaining sides of the stripper 100. While the edge surfaces 118 are generally vertical in nature, the exact shape of these surfaces is in fact not linear, as illustrated in FIGS. 5 and 6. For purposes of illustration, each edge surface 118 may be considered to be comprised of a separate upper curved or bevel filler region 120 and a lower linear or flat region 122, in much the same manner as the first embodiment described above. Furthermore, stripper 100 includes a generally flat upper surface 124, extending outwardly from which is a flexible, finger-like projection or deflector 126.

As was the case with the first embodiment described, trim stripper 100 is typically manufactured from a resilient material such as 70 to 100 durometer closed cell rubber, although foam or other materials exhibiting appropriate resilient characteristics may also be utilized.

Once again, the second trim stripper embodiment described herein is substantially like the first embodiment discussed above and performs essentially the same function as the trim stripper 10 of the first embodiment. However, the second trim stripper embodiment performs the additional function of deflecting the severed scrap material as it flies off of and generally away from the die cutting assembly. As such, the discussion of the second trim stripper embodiment presented below will be generally focused on a discussion of the strippers deflection capability.

Figure 8:
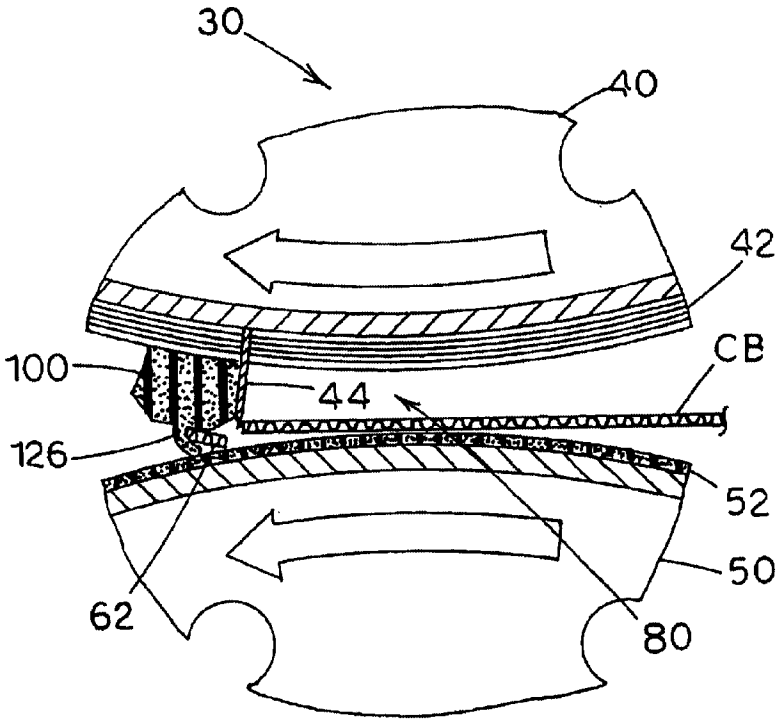
FIGS. 7–9 are a sequence of views showing the trim stripper of FIG. 5 and a corrugated board moving through the nip of a rotary die cutting assembly.
Figure 7:
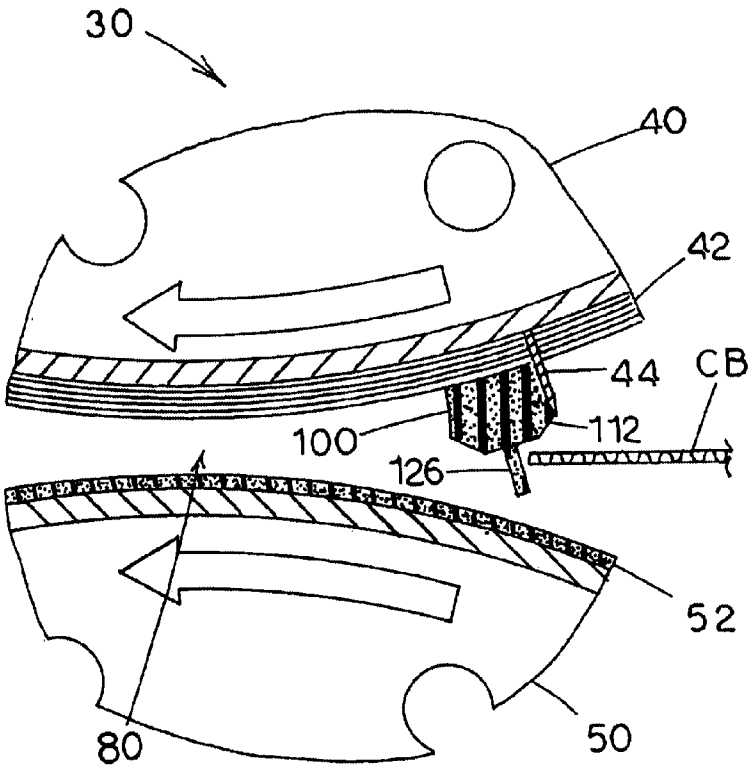
Figure 9:
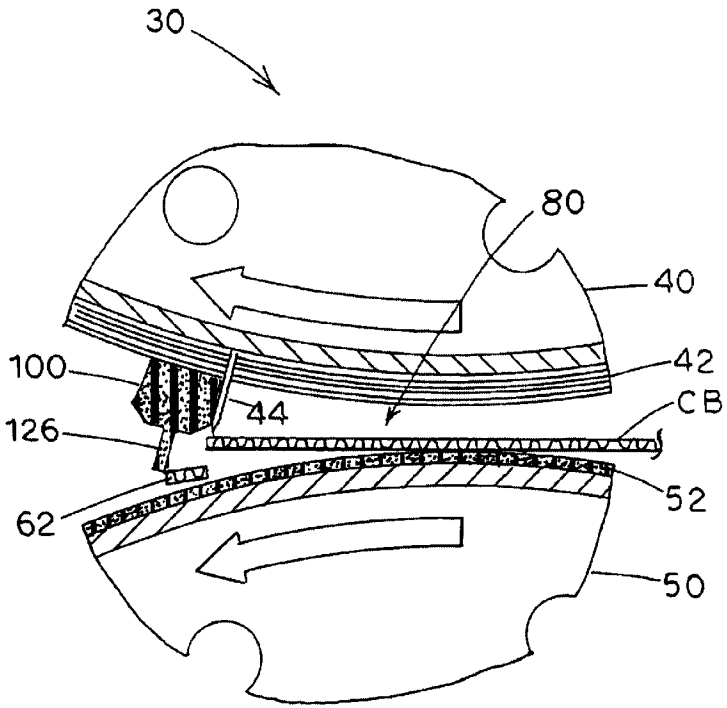
Figure 10:
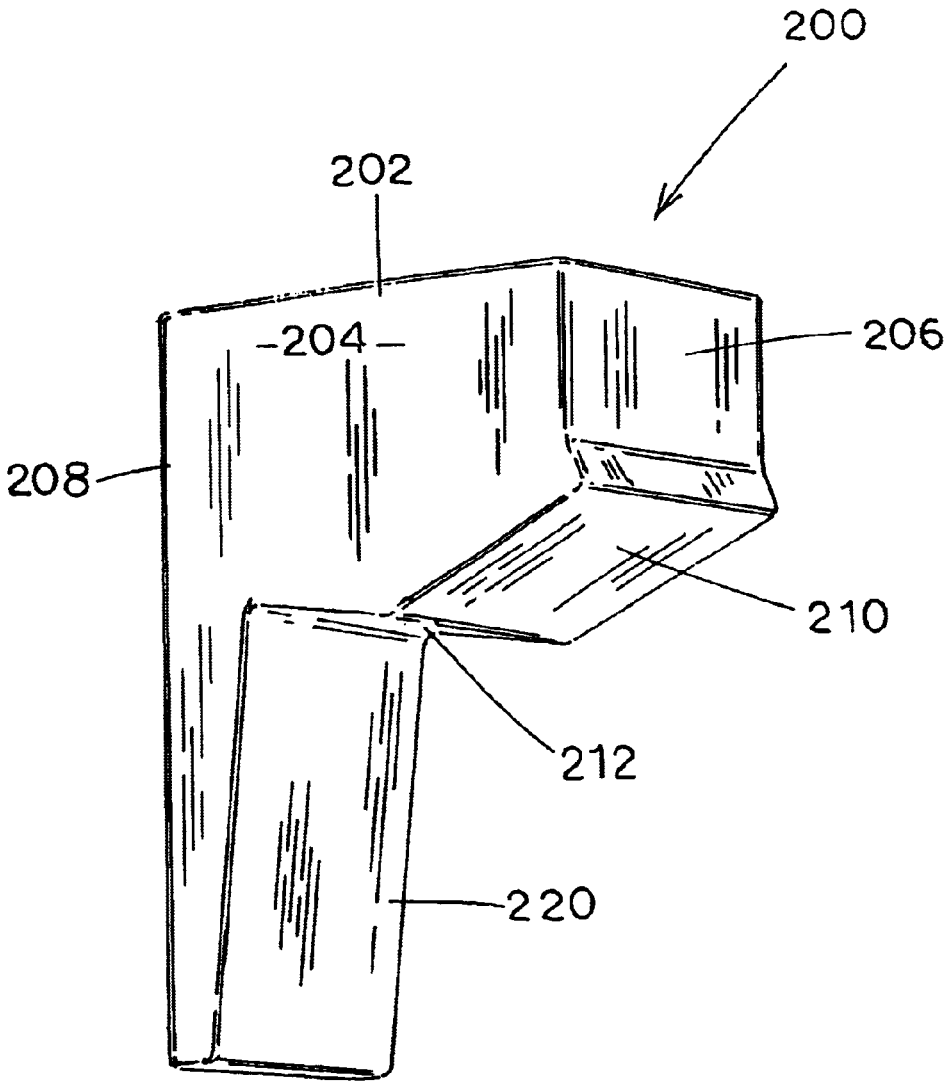
FIG. 10 is a perspective view of a third embodiment of the trim stripper of the present invention.
Figure 12:
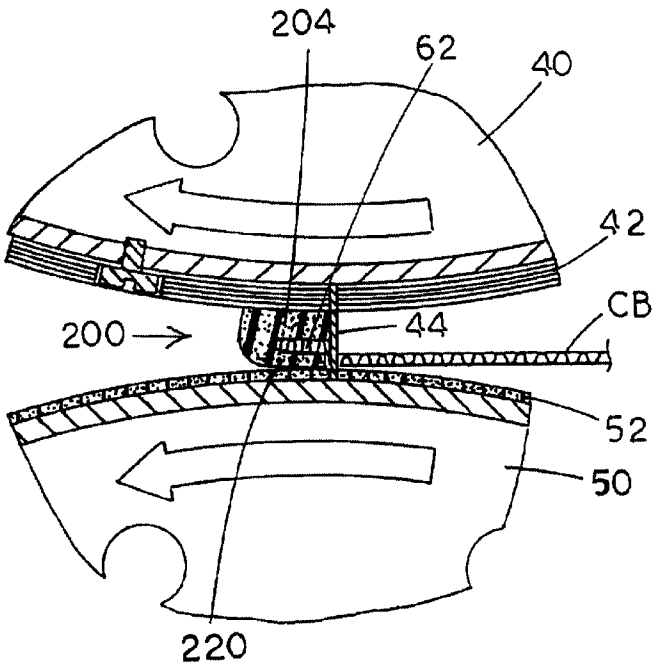
FIG. 12 is another side sectional view illustrating the trim stripper shown in FIG. 10 moving through the nip defined between the cutting die and anvil of the rotary cutting die assembly.
Figure 11:
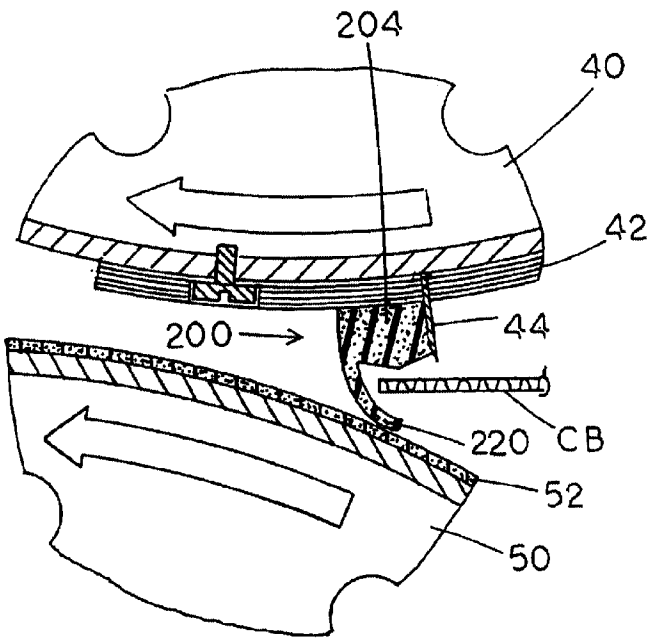
FIG. 11 is a side sectional view illustrating the movement of the trim stripper of FIG. 10 into the nip defined between the cutting die and anvil of the rotary die cutting assembly.

Illustrated in FIGS. 7–9, is the nip region of the corrugated board rotary cutting die apparatus 30. Trim stripper 100 is positioned on the die board 42 immediately adjacent the cutting blade 44, in a manner that is substantially the same as that described for the stripper 10 of the first embodiment. As shown in FIG. 7, trimming and stripping of the blank CB begins with the insertion or entry of the corrugated board blank into the die cutter 30. Insertion of the blank CB into the die cutter is synchronized with the position of the trimming or cutting blade 44, such that the edge of the blank that is to be trimmed enters the nip at approximately the same time as the cutting blade. The cutting blade 44 and incoming blank CB will tend to move together into and through the nip with the edge region of the blank that is to trimmed just leading the adjacent blade. As shown in FIG. 7, proper synchronization of the blank CB and cutting blade 44 also insures that the flexible deflector finger 126 leads the forward edge of the blank as it approaches the nip 80. As the stripper 100 approaches and passes through the nip, the angled surface 112 generally engages the blank and is elastically deformed in manner analogous to that described above for the first stripper embodiment. Furthermore, in the case of stripper 100, the flexible deflector finger 126 is deformed such that the tip of the finger is folded back generally towards the cutting blade 44, as illustrated in FIG. 8. After the stripper 100 passes through the nip 80, the elastically deformed deflector finger springs back to it's original, generally extended conformation. As such, the extended finger 126 effectively blocks or deflects the flight of the severed scrap 62, following release of the scrap by the angled surface 112 (FIG. 9). In so doing, the deflector 126 urges the ejected scrap 62 into a lower exit trajectory than might otherwise be accomplished.

In any event, the stripper 100 described in the second embodiment functions in much the same manner as that described above for the first stripper embodiment, with the added benefit of an integral deflector finger 126 which serves to further lower the exit trajectory of the severed scrap material and generally enhance the scrap-product separating performance of the overall rotary die cutting apparatus. That is, the angled surface 112 of the stripper serves to hold the scrap edge of the blank against the anvil cylinder 50 and effectively directs the severed scrap generally downwardly and away from the discharged blank product, while the finger 126 provides for additional downward deflection of the ejected scrap material once this scrap is released by the angled surface 112.

In FIGS. 10–14, there is shown a third embodiment for the trim stripper of the present invention. The third embodiment is generally similar to the second embodiment discussed above and indicated generally by the numeral 200 in the drawings. Viewing the trim stripper 200 in more detail, it is seen that the same includes a main body portion and a flexible finger or deflector portion. First viewing the main body portion of the trim stripper 200, it is seen that the same includes a base or upper surface 202 that is designed to be secured by glue or other suitable means to the die board 42 that forms a part of the rotary cutting die. In addition the main body portion includes a pair of opposed sides 204, a trailing edge 206, and a leading edge 208. It will be appreciated, that the trailing edge 206 is designed to be disposed adjacent the trim cutting blade 44. In the embodiment shown in FIG. 10, the trailing edge 206 is similar to the trailing edge of the trim strippers of the first and second embodiments discussed above. However, it should be noted that the particular shape of the trailing edge 206 can vary from one design to another design. In particular, it may be beneficial to effectively space the majority portion of the trailing edge 206 slightly from the trim cutting blade 44. This can be accomplished by cutting out a lower portion of the trailing edge 206. In this case, that portion of the trailing edge 206 disposed adjacent the base 202 would fit flush against the trim blade 44. Because of the cutout just discussed, there would be a small space on the order of 0.01 inch, for example, between the lower portion of the trailing edge 206 and the trim blade 44.

Continuing to refer to the main body of the trim stripper 200, it is seen that the same includes a pair of angled surfaces 210 and 212. The angled surface 210 would serve essentially the same purpose and function as the angled surfaces of the other embodiments discussed herein.

Now turning to FIGS. 11–14, there is shown therein a sequence of drawings that illustrates the operation of the trim stripper 200 as it passes through the nip defined between the cutting die 40 and the anvil 50. Note in FIG. 11 where the flexible finger or deflector 220 begin to deflect back around the leading edge of the corrugated board CB as the corrugated board is fed between the cutting die 40 and the anvil 50. As the trim stripper 200 advances through the nip defined between the cutting die and the anvil, it is seen that the flexible finger or deflector 220 curls back around a leading edge portion of the corrugated board CB. In particular, note in FIG. 12 where the leading edge portion of the corrugated board CB has actually been cut by the blade 44, forming a scrap piece 62. Scrap piece 62 is partially surrounded or encompassed by the flexible finger 220 and the main body portion of the trim stripper 200. Again this is particularly shown in FIG. 12. Moving to FIG. 13 it is seen that the trim stripper 200 has advanced clockwise to a point where it and the cut trim strip 62 has started to move from the nip defined between the cutting die 40 and the anvil 50. Even in this position, the cut trim 62 is still generally surrounded or retained by the flexible finger 220 and the main body portion of the trim stripper 200. Thus the trim stripper 200 is acting to exert control over the cut trim piece 62.

Figure 14:
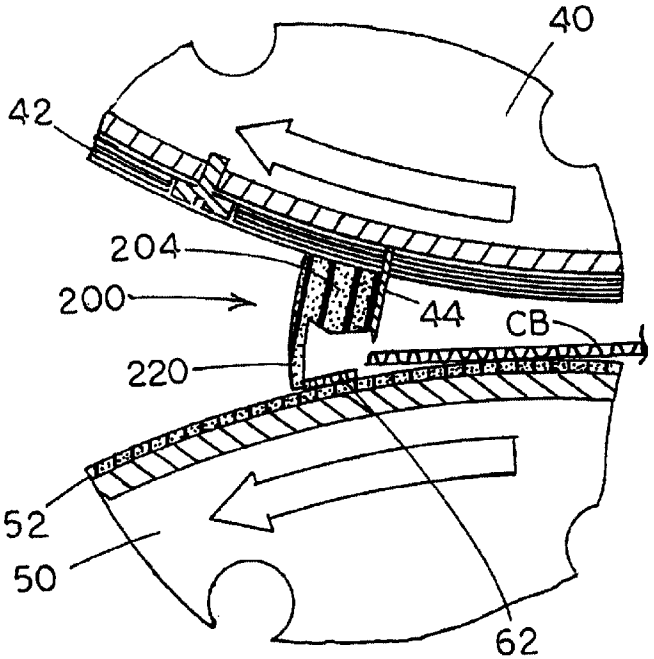
FIG. 14 is another side sectional view of the trim stripper of FIG. 10 moving yet further through the nip between the cutting die and anvil of a rotary die cutting assembly.
Figure 13:
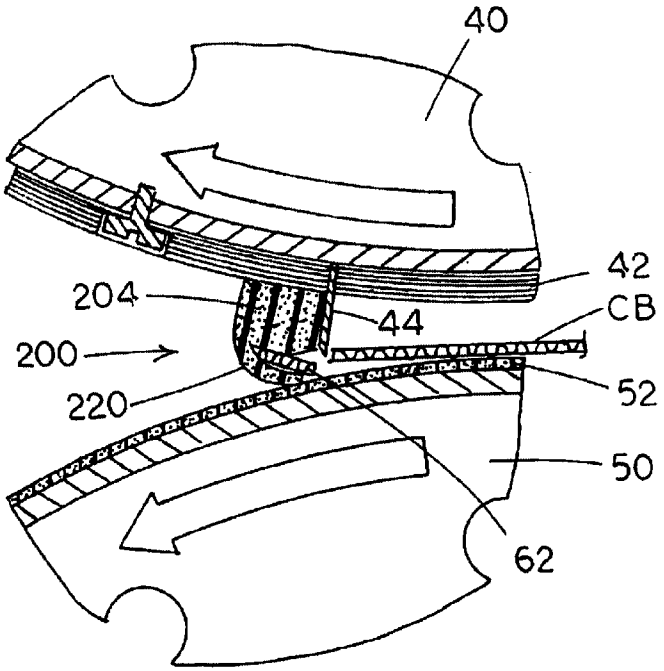
FIG. 13 is a side sectional view of the trim stripper of FIG. 10 moving further through the nip defined between the cutting die and anvil of a rotary die cutting assembly.

Viewing FIG. 14, the trim stripper 200 has advanced slightly clockwise from the position depicted in FIG. 13. Now the flexible finger or deflector 220 has extended and the cut scrap piece 62 has been released to where it lies atop the anvil. However, the deflector or flexible finger 220 still acts to deflect or control the exiting movement of the cut trim 62. Note in FIG. 14 that the flexible finger or deflector 220 has the effect of preventing the cut trim piece 62 from flying or moving past the deflector 220. More particularly, the action of the trim stripper and particularly the flexible finger or deflector 220 generally acts to encourage the cut trim piece 62 to lie against the anvil and to move therewith as the cut trim piece 62 exits the nip. This generally insures that the path of the cut trim 62 will follow the anvil and accordingly will be directed generally downwardly as it exits the discharge side of the cutting die and anvil.

Finally, it should be appreciated that the trim strippers disclosed herein can be placed at various locations on the cutting die for stripping trim from any portion of the corrugated board. Thus the trim strippers disclosed herein can be used to control the discharge of leading and trail edge of trim as well as side trim.

From the foregoing specification and discussion, it is seen that the design of the trim edge stripper of the present invention lends itself to making smooth contact with the leading edge of the corrugated board being fed into the die cutting assembly. Specifically, the angled surface of the stripper generally avoids the problem with hard and abrupt initial contact that can be prevalent with prior art trim strippers. Further, the angled upper surface of the trim stripper discourages the lodging of cut trim between the trim stripper and adjacent trim blades. This avoids numerous problems that are a result of cut trim becoming lodged between the strippers and adjacent trim blades. Finally, the design of the stripper is such that its normal extension beyond the adjacent trim blade tends to hold the cut trim adjacent the anvil at least momentarily as the stripper and cut trim scrap exit the nip of the die cutting assembly. This urges the cut trim scrap to follow a downwardly trajectory and provides for a more complete separation of the trim scrap from the corrugated product.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A rotary cutting die for cutting corrugated board and trimming an outside trim piece from the corrugated board so as to yield a product portion comprising:

(a) a base adapted to be mounted to a rotary cylinder;

(b) at least one trim cutting blade secured to the base and extending outwardly therefrom for trimming an outside trim piece from a sheet of corrugated board; and (c) at least one trim stripper mounted outside the trim cutting blade for engaging the trim piece and stripping the trim piece from the product portion, the trim stripper including an angled outer stripper surface that is angled outwardly and away from the trim blade in such a fashion that at least a portion of the angled outer stripper surface extends outwardly past the height of the trim blade.

2. The rotary cutting die of claim 1 wherein the cutting die is adapted to work in conjunction with a rotary anvil to trim a corrugated board sheet passing through a nip area formed between the rotating cutting die and anvil, and wherein the angled outer surface of the trim stripper acts to engage a leading edge of the corrugated board sheet as it enters the nip area and further the outer angled surface of the trim stripper contacts and holds one or more cut pieces of trim scrap against the anvil as the cut trim scrap exits the nip so as to cause the trim scrap to be directed generally downwardly by the anvil as the anvil transfers the cut trim scrap away from the nip area.

3. The rotary cutting die of claim 1 wherein the trim stripper is constructed of a closed cell rubber having a durometer of approximately 70–100.

4. The rotary cutting die of claim 1 wherein the angled surface of the trim stripper includes a trailing portion disposed adjacent the trim blade and a leading portion spaced forwardly of the trim blade and wherein there is provided a trim deflector that is disposed adjacent the leading portion of the angled surface and projects outwardly therefrom past the height of the trim blade.

5. The rotary cutting die of claim 1 wherein the trim stripper includes an edge that normally faces the trim cutting blade, and wherein the angled outer stripper surface and the edge facing the trim blade form an angle greater than 90 degrees.

6. The rotary cutting die of claim 5 wherein the edge of the trim stripper that normally faces the trim blade includes an upper beveled filler region that normally lies adjacent an upper beveled portion of the trim blade such that the trim stripper may assume a flush mounted position adjacent the trim blade.

7. The rotary cutting die of claim 1 wherein the cutting die is adapted to rotate in a given direction and the outer angled surface of the trim stripper intersects with an edge of the trim stripper that normally faces the trim blade to form an angle greater than 90 degrees, and wherein the upper surface of the stripper is angled such that it extends from the intersection with the edge outwardly with respect to the base and in the general direction that the cutting die is adapted to rotate such that the angled upper surface of the stripper leads the adjacent trim blade.

8. The rotary cutting die of claim 7 wherein the angled upper surface of the trim stripper includes a leading portion that extends outwardly past the height of the trim blade and a trailing portion that assumes a height that is approximately the height of the trim blade.

9. The rotary cutting die of claim 1 wherein the trim stripper includes two separate angled upper surfaces that enable the trim stripper to be reversed.

10. The rotary cutting die of claim 9 wherein the two angled upper surfaces form an apex that forms a demarcation between the respective upper surfaces.

11. The rotary cutting die of claim 1 including both trailing and leading trim blades and wherein at least one trim stripper is disposed adjacent the trailing trim blade and the leading trim blade.

12. The rotary cutting die of claim 11 wherein the outer stripper surface of each trim stripper is angled outwardly and away from the adjacent trim blade.

13. The rotary cutting die of claim 1 wherein the cutting die is operative to cooperate with an anvil to trim a sheet of corrugated board passing through a nip area defined between the cutting die and the anvil, and wherein the trim stripper includes a flexible finger that in a non-compressed position extends outwardly past the trim blade, and wherein the flexible finger functions to curl around a portion of a piece of cut trim as the flexible finger and cut trim pass through the nip defined between the cutting die and the anvil.

14. The rotary cutting die of claim 13 wherein the length of the flexible finger is such that, in a compressed position, it generally overlies a top portion of the trip stripper and includes a terminal end that terminates short of the trim blade.

15. The rotary cutting die of claim 1 wherein the trim stripper includes a flexible trim deflector.

16. The rotary cutting due of claim 15 wherein the trim stripper includes a main body portion and wherein a flexible finger projects outwardly from the main body portion; and wherein the main body portion includes a leading edge and a trailing edge, the trailing edge being disposed adjacent to the trim blade; and wherein the flexible finger projects from the main body portion at a point adjacent the leading edge of the main body portion of the trim stripper.

17. The rotary cutting die of claim 15 wherein the trim deflector is spaced from and leads the trim cutting blade.

18. The rotary cutting die of claim 17 wherein the trim deflector assumes the shape of a flexible finger.

19. The rotary cutting die of claim 18 wherein the trim stripper includes a main body portion and wherein the flexible finger extends outwardly from the main body portion.

20. The rotary cutting die of claim 19 wherein the finger is relatively thin compared to its transverse width.

21. The rotary cutting die of claim 19 wherein the flexible finger extends transversely across the main body portion of the trim stripper.

22. The rotary cutting die of claim 18 wherein the trim deflector is spaced from and leads the trim cutting blade.

23. A rotary cutting die for cutting corrugated board and trimming an outside trim piece from the cutting board so as to yield a product portion comprising:

(a) a base;

(b) at least one trim cutting blade secured to the base and extending outwardly therefrom for trimming an outside trim piece from a sheet of corrugated board; and (c) at least one trim stripper secured to the base and disposed outside of the trim cutting blade for engaging and stripping the outside trim piece from corrugated board, the trim stripper including a body portion and a flexible deflector projecting outwardly from the body portion for engaging the cut trim piece and generally assisting in controlling the movement of the cut trim piece after it has been cut by the cutting die.

24. The rotary cutting die of claim 23 wherein the body portion of the trim stripper includes an angled outer stripper surface that is angled outwardly and away from the trim blade in such a fashion that at least a portion of the angled surface extends outwardly past the height of the trim blade, and wherein the angled surface of the trim stripper includes a trailing portion disposed adjacent the trim blade and a leading portion spaced forwardly of the trim blade and wherein the trim deflector is disposed closer to the leading portion of the angled surface than the trailing portion of the angled surface.

25. The rotary cutting die of claim 23 wherein the deflector assumes the shape of a flexible finger that extends outwardly from the body portion of the trim stripper.

26. The rotary cutting die of claim 25 where the flexible finger extends transversely across the body portion of the trim stripper and extends outwardly past the height of the trim cutting blade.

27. The rotary cutting die of claim 26 wherein the finger is relatively thin compared to its transverse width.

28. A method of controlling and managing an outside trim piece cut from a sheet of corrugated board passing between a rotary cutting die and a rotating anvil comprising:

(a) directing the sheet of corrugated board between the rotary cutting die and the rotating anvil;

(b) engaging an outside trim edge portion of the sheet with an angled outer surface of a trim stripper carried by the cutting die and disposed outside a trim blade, said angled outer surface of the trim stripper is angled outwardly and away from the trim blade in such a fashion that at least a portion of the angled outer stripper surface extends outwardly past a height of the trim blade; and (c) cutting the outside trim edge portion of the corrugated board sheet with the trim blade while compressing the trim stripper between the cutting die and the trim edge portion being cut as the corrugated board passes between the cutting die and the anvil; and (d) releasing the trim stripper as the trim stripper and cut trim edge portion pass through a nip defined between the anvil and the cutting die causing the angled outer surface of the trim stripper to expand outwardly and engage the cut trim edge portion and strip the cut trim edge portion from the trim blade.

29. The method of claim 28 wherein the sheet of corrugated board includes a leading edge and wherein the method includes directing the leading edge of the sheet of corrugated board into contact with the angled outer surface of the trim stripper.

30. The method of claim 28 including engaging the cut trim with a flexible deflector that forms a part of the trim stripper.

31. The method of claim 30 including engaging the cut trim with a back side of the deflector and effectively limiting the outward movement of the cut trim as it exits the nip between the cutting die and the anvil.

32. The method of claim 30 including curling the flexible deflector around the cut trim portion as the trim stripper and cut trim portion pass through the nip.

33. The method of claim 30 wherein the flexible deflector projects downwardly from the cutting die and as the deflector and cut trim portion exit the nip, the deflector engages the cut trim portion and deflects the same downwardly.

34. The method of claim 33 wherein the flexible deflector includes an elongated finger that projects from a main body portion of the trim stripper and wherein as the finger passes through the nip it tends to curl back and around a cut trim portion causing the cut trim portion to be held between the curled finger and the main body portion of the trim stripper.

35. The method of claim 34 wherein the finger is of a selected length such that when the finger curls back it does not extend substantially past the main body portion of the trim stripper.

* * * * *